US011866904B2

(12) United States Patent
Bitter

(10) Patent No.: US 11,866,904 B2
(45) Date of Patent: Jan. 9, 2024

(54) FACE SHOVEL AND METHOD OF OPERATION

(71) Applicant: Caterpillar Global Mining LLC, Tucson, AZ (US)

(72) Inventor: Marcus Bitter, Dortmund (DE)

(73) Assignee: Caterpillar Global Mining LLC, Tucson, AZ (US)

( * ) Notice: Subject to any disclaimer, the term of this patent is extended or adjusted under 35 U.S.C. 154(b) by 603 days.

(21) Appl. No.: 16/972,421

(22) PCT Filed: Jun. 6, 2019

(86) PCT No.: PCT/US2019/035804
§ 371 (c)(1),
(2) Date: Dec. 4, 2020

(87) PCT Pub. No.: WO2019/236855
PCT Pub. Date: Dec. 12, 2019

(65) Prior Publication Data

US 2021/0230827 A1 Jul. 29, 2021

(30) Foreign Application Priority Data

Jun. 6, 2018 (GB) ..... 1809326

(51) Int. Cl.
*E02F 3/30* (2006.01)
*E02F 3/407* (2006.01)
(Continued)

(52) U.S. Cl.
CPC ..... *E02F 3/308* (2013.01); *E02F 3/4075* (2013.01); *E02F 3/422* (2013.01); *E02F 3/435* (2013.01); *E02F 9/2004* (2013.01); *E02F 3/437* (2013.01)

(58) Field of Classification Search
CPC ..... E02F 3/308; E02F 3/4075; E02F 3/422; E02F 3/435; E02F 9/2004; E02F 3/437; E02F 3/434; E02F 3/404; E02F 3/439
See application file for complete search history.

(56) References Cited

U.S. PATENT DOCUMENTS 3,341,041 A 9/1967 Salna
3,773,196 A * 11/1973 Shepherd ..... E02F 3/407 37/444
(Continued)

FOREIGN PATENT DOCUMENTS

CN 103225322 7/2013
CN 104294870 1/2015
(Continued)

OTHER PUBLICATIONS

International Search Report related to Application No. PCT/US2019/035804; dated Jul. 31, 2019.
(Continued)

*Primary Examiner* — Nicholas Kiswanto
*Assistant Examiner* — Madison B Emmett
(74) *Attorney, Agent, or Firm* — von Briesen & Roper, s.c.

(57) ABSTRACT

A digging machine such as a face shovel is controlled in an automated dumping sequence in which the bucket is pivoted to a first angular orientation before opening and, optionally, re-orienting to a second, slightly more forwardly inclined angular orientation. The first orientation may relieve the front part of the bucket from the load while the second orientation is selected to discharge the load at an optimal trajectory. The bucket may move to a third angular orientation before closing the front part against gravity.

15 Claims, 8 Drawing Sheets

(51) Int. Cl.

| | |
|---|---|
| ***E02F 3/42*** | (2006.01) |
| ***E02F 3/43*** | (2006.01) |
| ***E02F 9/20*** | (2006.01) |

(56) References Cited

U.S. PATENT DOCUMENTS

| | | | | |
|---|---|---|---|---|
| 3,869,054 | A * | 3/1975 | Moreau | E02F 3/407 37/444 |
| 4,015,729 | A | 4/1977 | Parquet et al. | |
| 5,446,980 | A | 9/1995 | Rocke | |
| 5,682,312 | A | 10/1997 | Rocke | |
| 6,408,551 | B1 * | 6/2002 | Pettersson | E02F 3/405 37/444 |
| 6,467,202 | B1 * | 10/2002 | Brown, Jr. | E02F 3/4075 37/445 |
| 6,591,521 | B2 * | 7/2003 | Brown | E02F 3/4075 37/445 |
| 7,797,860 | B2 | 9/2010 | Schoenmaker et al. | |
| 8,113,763 | B2 * | 2/2012 | Hagenbuch | B60P 1/28 414/397 |
| 8,142,132 | B2 | 3/2012 | Lech et al. | |
| 9,452,912 | B1 * | 9/2016 | Bergeron | E02F 3/4135 |
| 9,458,598 | B2 | 10/2016 | Takaura et al. | |
| 10,662,612 | B1 * | 5/2020 | Frost | E02F 3/4133 |
| 2005/0116076 | A1 * | 6/2005 | Went | B02C 1/02 241/291 |
| 2007/0135985 | A1 | 6/2007 | Berry et al. | |
| 2008/0263909 | A1 | 10/2008 | Schoenmaker et al. | |
| 2008/0282583 | A1 * | 11/2008 | Koellner | E02F 3/304 37/348 |
| 2010/0206975 | A1 * | 8/2010 | Ueda | E02F 3/965 241/283 |
| 2013/0195594 | A1 * | 8/2013 | Knuth | E02F 3/4075 414/722 |
| 2014/0079519 | A1 | 3/2014 | Hobenshield | |
| 2014/0338235 | A1 * | 11/2014 | Ryan | E02F 3/435 701/50 |
| 2015/0020636 | A1 * | 1/2015 | Dretzka | E02F 3/304 74/490.01 |
| 2015/0240444 | A1 | 8/2015 | Knuth | |
| 2016/0002878 | A1 | 1/2016 | Harper | |
| 2017/0073925 | A1 | 3/2017 | Friend et al. | |
| 2017/0218594 | A1 | 8/2017 | Padilla | |
| 2017/0298592 | A1 * | 10/2017 | Akanda | E02F 3/304 |
| 2018/0106016 | A1 * | 4/2018 | Uji | G05B 19/042 |
| 2020/0018037 | A1 * | 1/2020 | Nakamura | E02F 3/43 |
| 2021/0262204 | A1 * | 8/2021 | Tafazoli Bilandi | E02F 9/261 |

FOREIGN PATENT DOCUMENTS

| | | |
|---|---|---|
| CN | 105452572 | 3/2016 |
| EP | 3181763 A1 | 6/2017 |
| GB | 2068890 A | 8/1981 |

OTHER PUBLICATIONS

Great Britain Search Report related to Application No. 1809326.0; dated Nov. 16, 2018.

* cited by examiner

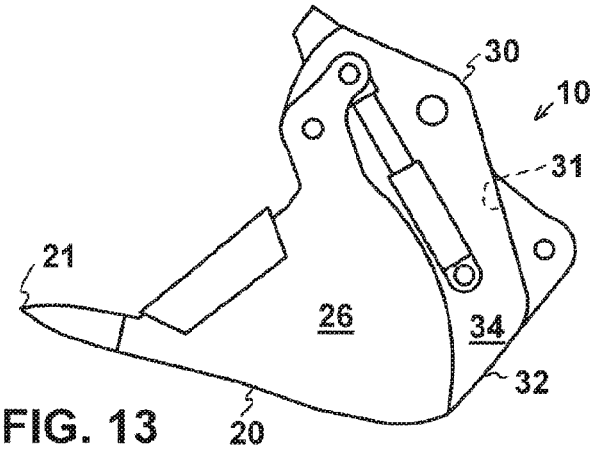
FIG. 13
FIG. 14
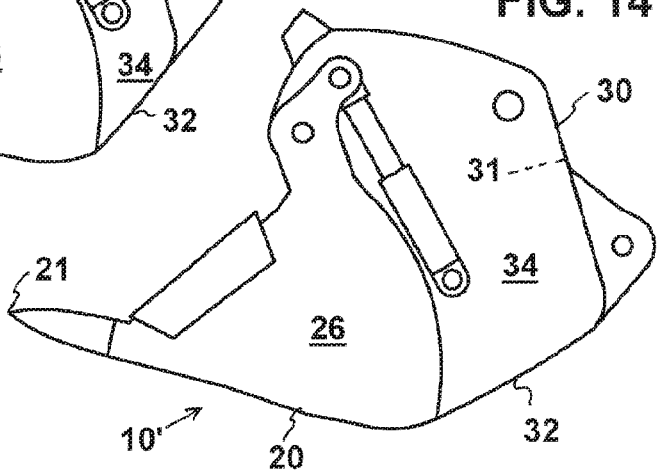
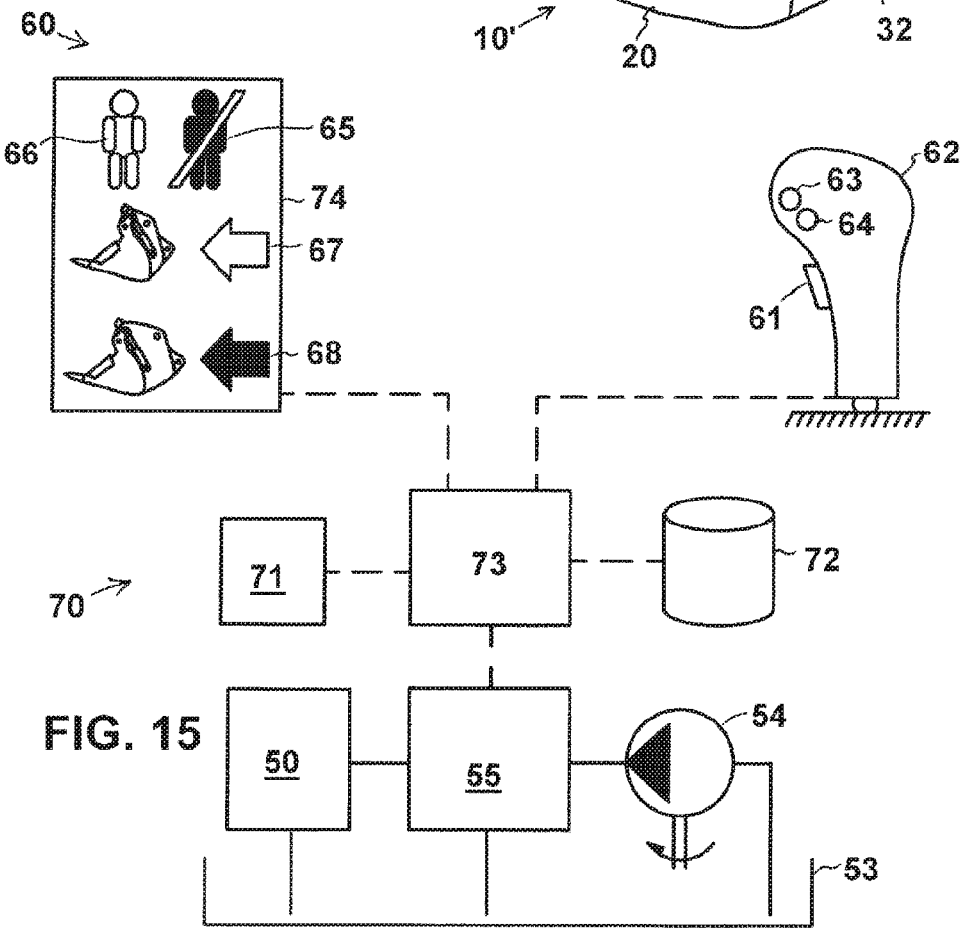
FIG. 15

FACE SHOVEL AND METHOD OF OPERATION

CROSS-REFERENCE TO RELATED APPLICATION

This Application is a 35 USC § 371 US National Stage filing of International Application No. PCT/US2019/035804 filed on Jun. 6, 2019 which claims priority under the Paris Convention to Great Britain Patent Application No, 1809326.0 filed on Jun. 6, 2018.

TECHNICAL FIELD

This disclosure relates to digging machines, including in particular face shovels, in which the bucket or shovel is formed in two parts which are openable and closeable between a digging configuration and a dumping configuration.

BACKGROUND

In the specification, a digging machine means a machine having an implement which is configured to selectively remove loose material from a body of material and deposit it in another location, for example, in a vehicle. In this specification the implement is referred to as a bucket, the terms bucket and shovel being used interchangeably.

In many digging machines the bucket is pivotably mounted at the distal end of a rigid supporting arm conventionally referred to as a stick, which in turn is pivotably mounted at the distal end of a rigid supporting arm conventionally referred to as a boom. Usually the three parts are moveable by means of hydraulic rams while the boom is pivotably mounted on the body of the machine, which may be moveable on wheels or tracks.

For many applications it is common to control the operation of the bucket by a combination of manual controls and pre-defined, automatic routines which are selectable by the operator to perform certain repetitive tasks.

U.S. Pat. No. 5,446,980A for example teaches an excavating machine with a control system arranged to sense the hydraulic cylinder pressures and the position of the bucket, stick and boom and to move the bucket automatically to perform repeated digging and dumping operations responsive to an operator command. The movement may be configured to jerk or shake the bucket to assist in dumping an adherent material from the bucket.

US20160002878A1 teaches a similar machine in which the control system is arranged to return the bucket to an incrementally advanced digging position.

Face shovels represent a specialised type of digging machine, being typically very large machines used in strip mining and similar operations. The bucket or shovel comprises a front part, commonly known as a clam, and a rear part or rear wall on which the front part is pivotably mounted. The front part is pivotable relative to the rear part to define a dumping configuration in which the material can drop out of the bucket via an aperture formed between the separated lower edges of the front and rear parts, and a digging configuration in which the lower edges are closed together to retain the material in the bucket.

Face shovels typically are configured to slew in a horizontal plane on a tracked base, and are arranged so that in the digging configuration a leading edge of the front part of the bucket can be moved upwardly and outwardly to dig or scoop loose material from a work face into the bucket. The leading edge may comprise a hardened blade or teeth suitable for the intended material, which may be for example rock loosened by blasting. For the digging operation the machine may be positioned for example as shown in FIGS. 1, 3 and 5. The machine may then slew through a quarter, half or three quarter turn before opening the front part of the bucket as shown in FIGS. 2, 4 and 6 to dump the material in a waiting vehicle drawn up beside the machine.

Typically the work face will be steeply angled, and in a large face shovel the bucket may have a volume of 50 $m^3$ or more. In consequence, depending on the height and slope angle of the work face, a large face shovel can rapidly create an unstable condition involving potentially many hundreds of tonnes of material. The operator therefore must pay constant attention to the changing state of the work face to avoid the development of a dangerous condition in which a large mass of loosened material (e.g. a solid rock or an overhang) could fall onto the machine. For this reason face shovels are typically operated under manual control rather than using an automated work routine.

Other operational considerations arise from the arrangement of the two-part shovel. The front part of the bucket is a very large and heavy component, comprising a front wall supported between two end walls. In the digging configuration the two parts of the bucket are closed together so that the crowd (digging) force applied by the machine to the work face via the leading edge of the front part is reacted against the back part by the abutment of the respective lower edges of the two parts. Thus, during digging, the bucket operates as if it were a single part.

In order for the bucket to open properly in its dumping configuration, the end walls necessarily reduce in size to a relatively narrow neck at the point at which they are pivotably connected to the rear part. Conventionally the hydraulic cylinders which control the opening and closing movement of the front part of the bucket are concealed within the rear part of the bucket, and act on a short extension of the neck.

The short extension provides very limited mechanical advantage for opening the bucket, while the narrow neck and other parts connected to it are vulnerable to damage, for example, if an inexperienced operator attempts to dig with the bucket in its dumping configuration. Due to its weight, the front part of the bucket can also damage the opening mechanism and connected parts if it is allowed to close rapidly under gravity. For this reason, after dumping the material from the bucket, it is preferred to move the rear part to a downwardly facing position with the front part hanging below it, for example as shown in FIG. 7, before operating the closing cylinders to raise the front part to the closed position. In this way the closing operation is regulated by the weight of the bucket so that the bucket moves progressively and safely to the closed position.

The experienced operator will also pay close attention to the position of the bucket during dumping to ensure that the dumped material falls straight into the waiting vehicle as shown in FIG. 4. If the rear part is tipped too far forward then the material may slide over the inclined inner surface of the front part of the bucket and fall to one side of the vehicle, as shown in FIG. 2. If the rear part is tipped too far back then the material may slide over the inclined inner surface of the rear part of the bucket and fall to the other side of the vehicle, as shown in FIG. 6. The sliding material will prematurely wear the inner surfaces of the front and rear parts, so that by selecting the correct dumping position as shown in FIG. 4 the operator can also maximise the life of the bucket.

SUMMARY

In its various aspects the present disclosure provides a digging machine and a method of operating the digging machine, as defined in the claims.

The digging machine comprises a bucket, an arm assembly supporting the bucket, and an actuator assembly for moving the bucket and arm assembly to crowd loose material into the bucket and to dump the loose material from the bucket. A control system is arranged to control the operation of the actuator assembly responsive to user commands received via user controls.

The bucket comprises a front part, a rear part, and a digging aperture through which loose material may be crowded into the bucket when the bucket is closed in a digging configuration of the front part. The rear part is pivotably mounted on the arm assembly. The actuator assembly is configured to move the rear part in rotation, when considered in a vertical plane, in opposite, forward and rearward directions through a range of angular positions in an angular range of movement.

When considered in the digging configuration of the front part, the forward direction is defined as an angular movement away from an upwardly facing orientation of the bucket and towards a downwardly facing orientation of the bucket, and the rearward direction is defined as an angular movement away from the downwardly facing orientation of the bucket and towards the upwardly facing orientation of the bucket.

The front part comprises a leading edge of the digging aperture and is moveable in rotation by the actuator assembly relative to the rear part between the digging configuration and a dumping configuration.

In the dumping configuration, respective edges of the front part and rear part are separated to define between said edges a dumping aperture through which loose material may fall downwardly out of the bucket in the upwardly facing orientation of the bucket, while in the digging configuration the front and rear parts are closed together to retain the loose material in the bucket in the upwardly facing orientation of the bucket.

The control system is arranged, responsive to at least a dump command received via the user controls, to control the actuator assembly to move the bucket in a dump sequence comprising a predefined sequence of movements, including a pre-positioning step followed by an opening step.

In the pre-positioning step, in the digging configuration of the front part, the rear part is moved in rotation to a first dump orientation. The first dump orientation is a first predefined angular position or range of angular position of the rear part in the angular range of movement.

After the pre-positioning step, in the opening step, the front part is moved from the digging configuration to the dumping configuration.

Optionally, the dump sequence may comprise a further movement or re-positioning step which is carried out during, after, or both during and after the opening step.

In the re-positioning step, the rear part is moved in rotation in the forward direction away from the first dump orientation to a second dump orientation. The second dump orientation is a second predefined angular position or range of angular position of the rear part in the angular range of movement.

Optionally, the dump sequence may comprise a further sequence of movements comprising a first closing step and a second closing step, which is carried out to close the bucket after the opening step or re-positioning step.

In the first closing step, the rear part is moved in rotation in the forward direction away from the first dump orientation to a closing orientation. The closing orientation is a further predefined angular position or range of angular position of the rear part in the angular range of movement.

Either during, after, or both during and after the first closing step, in the second closing step, the front part is moved from the dumping configuration to the digging configuration.

BRIEF DESCRIPTION OF THE DRAWINGS

Further features and advantages will be appreciated from the following illustrative embodiment which will now be described, purely by way of example and with reference to the accompanying drawings, in which:

FIGS. 13 and 14 show two buckets which may be selectively and alternatively mounted on the machine;

FIG. 15 shows a control system and actuator assembly of the machine; and

Reference numerals appearing in more than one of the FIGS. indicate the same or corresponding parts in each of them.

Referring to FIGS. 1-6, the illustrated digging machine 1 is configured as a face shovel comprising a bucket 10 which is mounted on an arm assembly 40. The arm assembly comprises a first rigid arm or stick 41 which is pivotably mounted on a second rigid arm or boom 42. The boom 42 is pivotably mounted on a body or house 43 of the machine 1, the house 43 being supported on a bearing or slew ring 44 to pivot or slew about a vertical axis, for example, between a digging position (FIG. 1) and a dumping position (FIG. 2). The house is mounted on a tracked base 45 so that the machine 1 can move along a work face to dig loose material 2 such as sand or blasted rock from the work face and dump it into a waiting vehicle 3.

FIGS. 13 and 14 show two alternative buckets 10, 10' which may be mounted interchangeably at the distal end of the stick 41, the first bucket 10' having a larger capacity than the second bucket 10. Either of the buckets 10, 10' may be selected for use depending on the material which is to be dug. In each of the drawings the bucket 10, 10' is shown from one side; it will be appreciated that the other side is typically identical, with the bucket 10, 10' extending in its width dimension between the two sides. Since the width dimension of the bucket 10, 10' is commonly selected to conform to an industry standard for the size of machine 1 on which it is to be mounted, the capacity of the bucket 10, 10' is determined by its depth from its leading edge 21 to its rear wall 31, for which reason the smaller illustrated bucket 10 has a shorter and more steeply angled base wall 32 than the larger bucket 10'.

Figure 1:
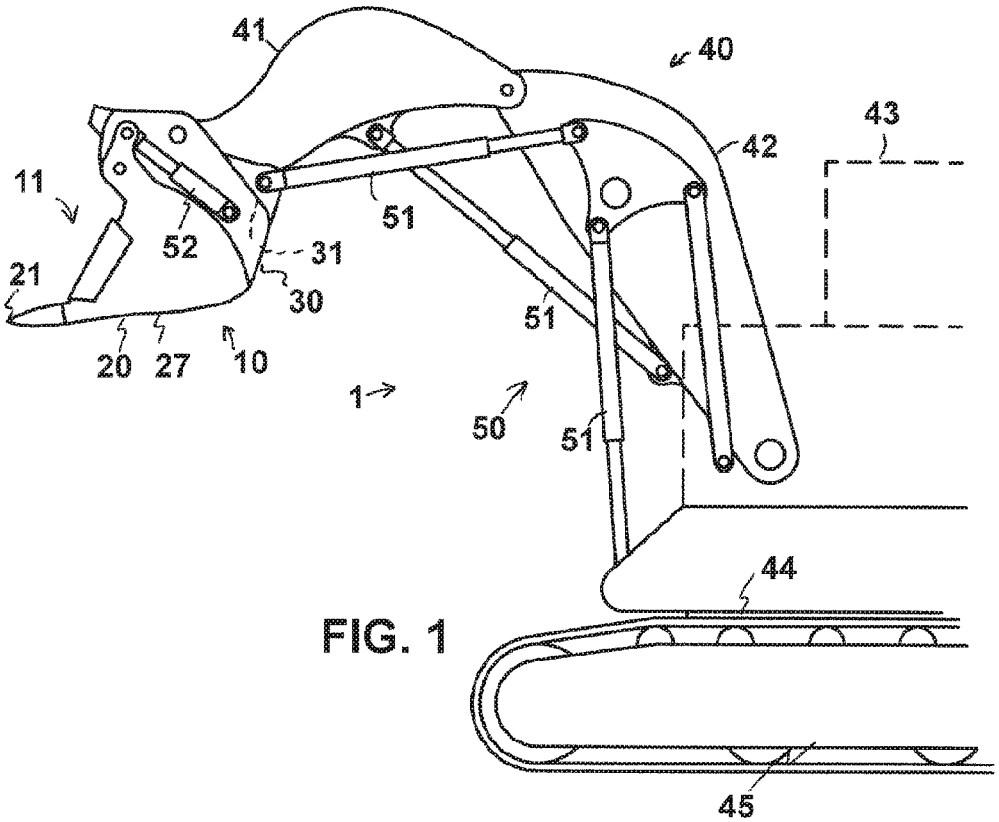
FIGS. 1 and 2 show a digging machine with its bucket in a slightly downwardly facing orientation, respectively in a digging (closed) configuration (FIG. 1) and in a dumping (open) configuration to dump loose material from the bucket into a vehicle (FIG. 2)

Each bucket 10, 10' comprises a front part 20 and a rear part 30; the front part 20 is mounted for rotation about a pivot 22 on the rear part 30, while the rear part is mounted for rotation about a pivot 33 on the distal end of the stick 41. In this way the bucket 10, 10' is supported on the arm assembly 40 for rotational movement in a vertical plane, which is to say, in the plane of each of FIGS. 1-14. It will be understood that generally in this specification, rotational movement may refer to rotation about a single pivot axis or about two or more pivot axes, optionally in combination with movement in translation, depending on how the components are articulated together and which of the actuators are used to accomplish the movement.

The leading edge 21 of the front part 20 may be formed with a series of hardened teeth or a straight edge and forms the leading, lower edge or lip of the digging aperture 11 through which the bucket is loaded with loose material.

Referring also to FIG. 15, the bucket and arm assembly are moveable by an actuator assembly 50 which in the illustrated embodiment comprises a number of hydraulic actuators 51, 52, each having a ram or piston slidably received in a casing or cylinder and operable by hydraulic fluid supplied from a tank 53 via a pump 54 as well known in the art. The opening and closing movement of the front part 20 may be controlled by two actuators 52 which are arranged, one on either side of the bucket, each actuator typically being concealed between two parallel side walls of the rear part 30 of the bucket to act on a short extension 23 of the neck 24 which extends from each side wall 26 of the front part 20. In the drawings, the outer side wall of the rear part is removed to show one of the actuators 52 in front of one of the inner side walls 34 of the rear part.

The operation of the actuator assembly is controlled by a control system 70 which typically will comprise a group of user controls 60 and a valve assembly 55 to supply the pressurised hydraulic fluid selectively to each of the actuators 51, 52. The control system is operable responsive to user commands received via the user controls 60 to control the actuator assembly 50, for example, to move the bucket 10, 10' and arm assembly 40 to crowd (i.e. urge) loose material 2 via the digging aperture 11 into the bucket 10, 10' and to dump the loose material via the dumping aperture 12 from the bucket 10, 10', for example, into the vehicle 3 as shown.

Figure 2:
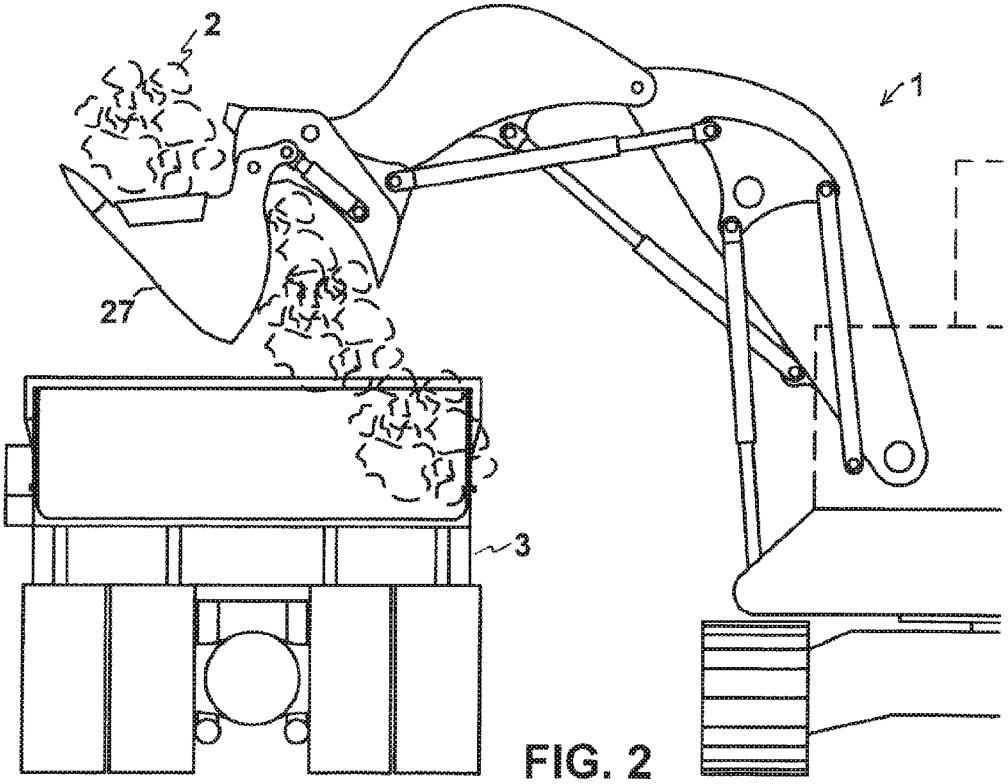
Figure 3:
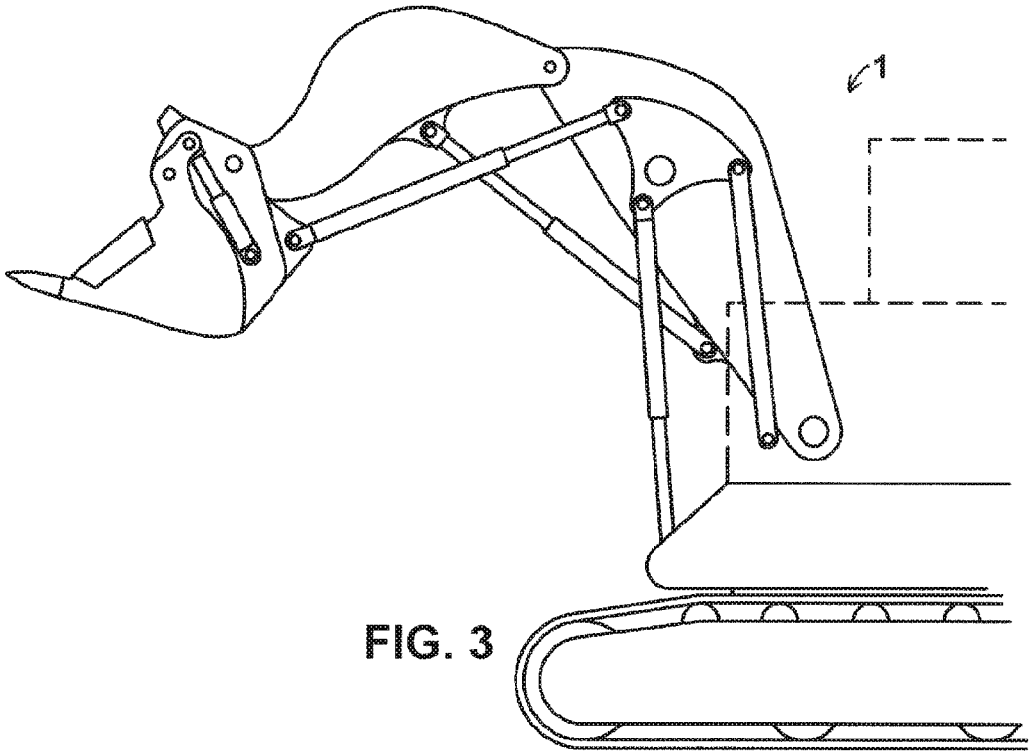
FIGS. 3 and 4 show the digging machine with its bucket in an upwardly facing, second dump orientation, respectively in the digging configuration (FIG. 3) and the dumping configuration (FIG. 4)
Figure 4:
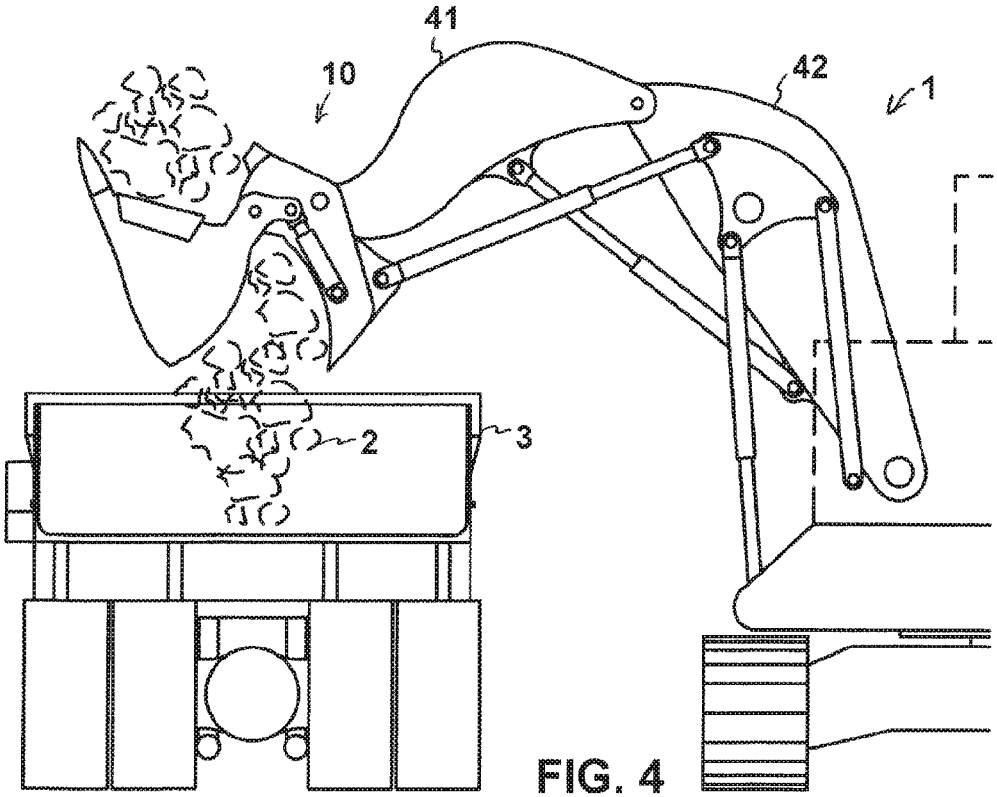
Figure 5:
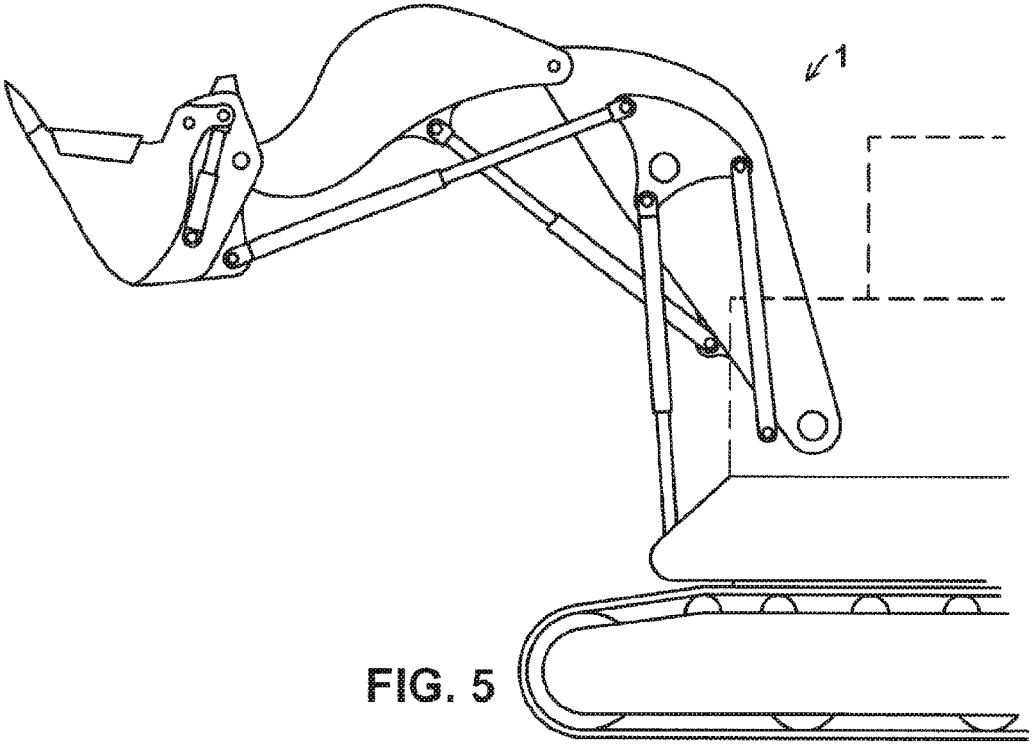
FIGS. 5 and 6 show the digging machine with its bucket rotated rearwardly to a more steeply upwardly facing orientation, respectively in the digging configuration (FIG. 5) and the dumping configuration (FIG. 6)
Figure 6:
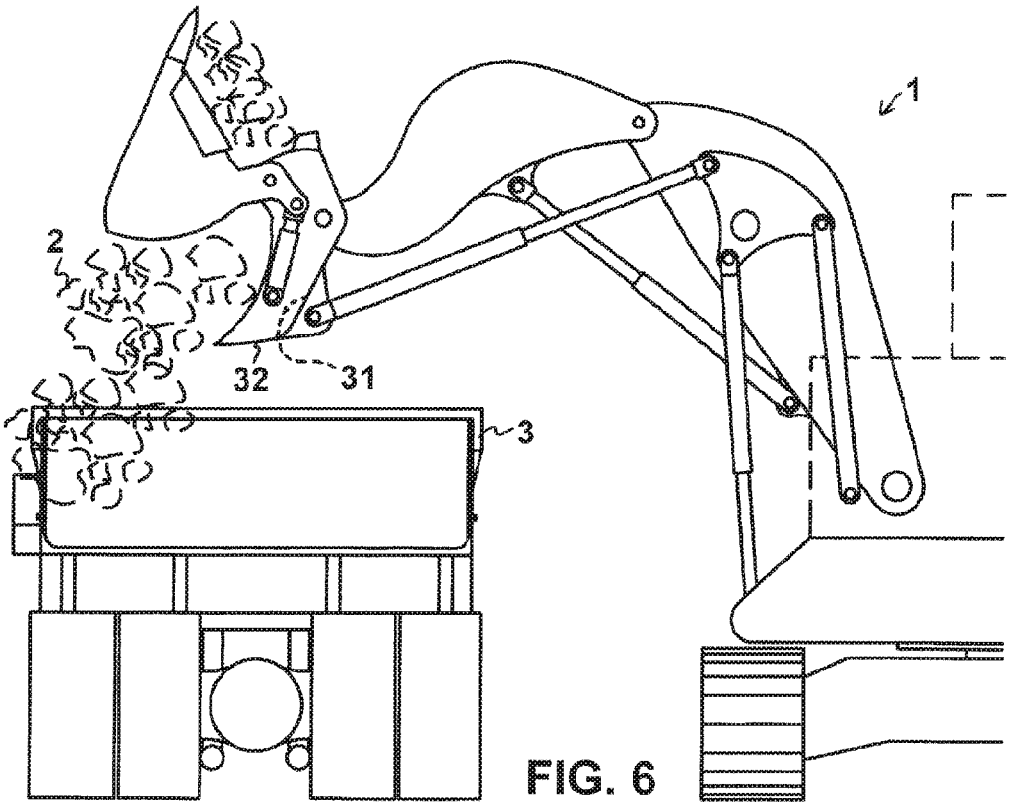

The actuator assembly 50, specifically actuators 52 are operable to move the front part 20 of the bucket 10, 10' in rotation relative to the rear part 30 between a closed, digging configuration (FIGS. 1, 3, 5) and an open, dumping configuration (FIGS. 2, 4, 6).

In the digging configuration, the front and rear parts 20, 30 are closed together so that the front part 20 is supported in contact with the rear part 30.

In the dumping configuration, respective lower, opposed edges 25, 35 of the front part 20 and rear part 30 are separated to define between them the dumping aperture 12 through which the loose material may be dumped to fall downwardly out of the bucket 10, 10' in the upwardly facing orientation of the bucket 10, 10'.

The actuator assembly 50 is further configured to move the rear part 30 in rotation, when considered in the vertical plane of the drawings, in opposite, forward (D1) and rearward (D2) directions through a range of angular positions as illustrated in an angular range of movement. With the front part 20 in the digging configuration, the forward direction D1 is defined as an angular movement away from the upwardly facing orientation and towards the downwardly facing orientation of the bucket 10, 10'. The rearward direction D2 is defined as an angular movement away from the downwardly facing orientation and towards the upwardly facing orientation of the bucket 10, 10'.

When the bucket 10, 10' is arranged in the upwardly facing orientation, i.e. so that it opens upwardly at the digging aperture 11, the front and rear parts 20, 30 retain the loose material 2 in the bucket 10, 10' when it is crowded into the bucket over the leading edge 21 of the front part 20 through the digging aperture 11. When the bucket is arranged in a downwardly facing orientation, the loose material can be discharged downwardly from the digging aperture 11 over the leading edge 21 without opening the dumping aperture 12. This is useful for example if the loose material includes a solid rock which is too large to pass through the dumping aperture.

The user controls 60 may include a front part opening control, such as a trigger 61 arranged on a joystick 62 which is operable to control the movements of the bucket 10, 10' and arm assembly. In a manual mode of operation, the trigger 61 or other front part opening control may be operable by a user, perhaps in combination with a safety button 63, to generate a front part opening command to open the bucket 10, 10', which is to say, to move the front part 20 from the digging configuration to the dumping configuration.

FIG. 2 illustrates how the loose material 2 may be discharged in an inclined trajectory if the front part 20 is opened to the dumping configuration when the rear part 30 is rotated too far in the forward direction D1. In this orientation the loose material 2 slides over the front wall 27 of the front part 20, causing premature wear of the internal protection plates.

In the same orientation of the rear part 30 as shown in FIG. 1, and before opening the front part 20, it can be seen that any loose material in the bucket 10, 10' will rest principally on the front wall 27 of the front part 20, so that the actuators 52 are required to raise not only the weight of the front part 20 but also the weight of the entire load of loose material 2 in order to open the bucket 10, 10'. In this orientation, a heavy load may prevent the bucket 10, 10' from opening properly.

FIG. 6 illustrates how the loose material 2 may be discharged in an inclined trajectory in the opposite direction if the front part 20 is opened to the dumping configuration when the rear part 30 is rotated too far in the rearward direction D2. In this orientation the loose material 2 slides over the rear wall 31 or base wall 32 of the rear part 30, again causing premature wear of the internal protection plates inside the bucket 10, 10'.

Although an experienced operator will try to avoid these situations, it has been observed that in many face shovels it is often difficult to observe the angular orientation of the bucket 10, 10' in normal operation.

Figure 16:
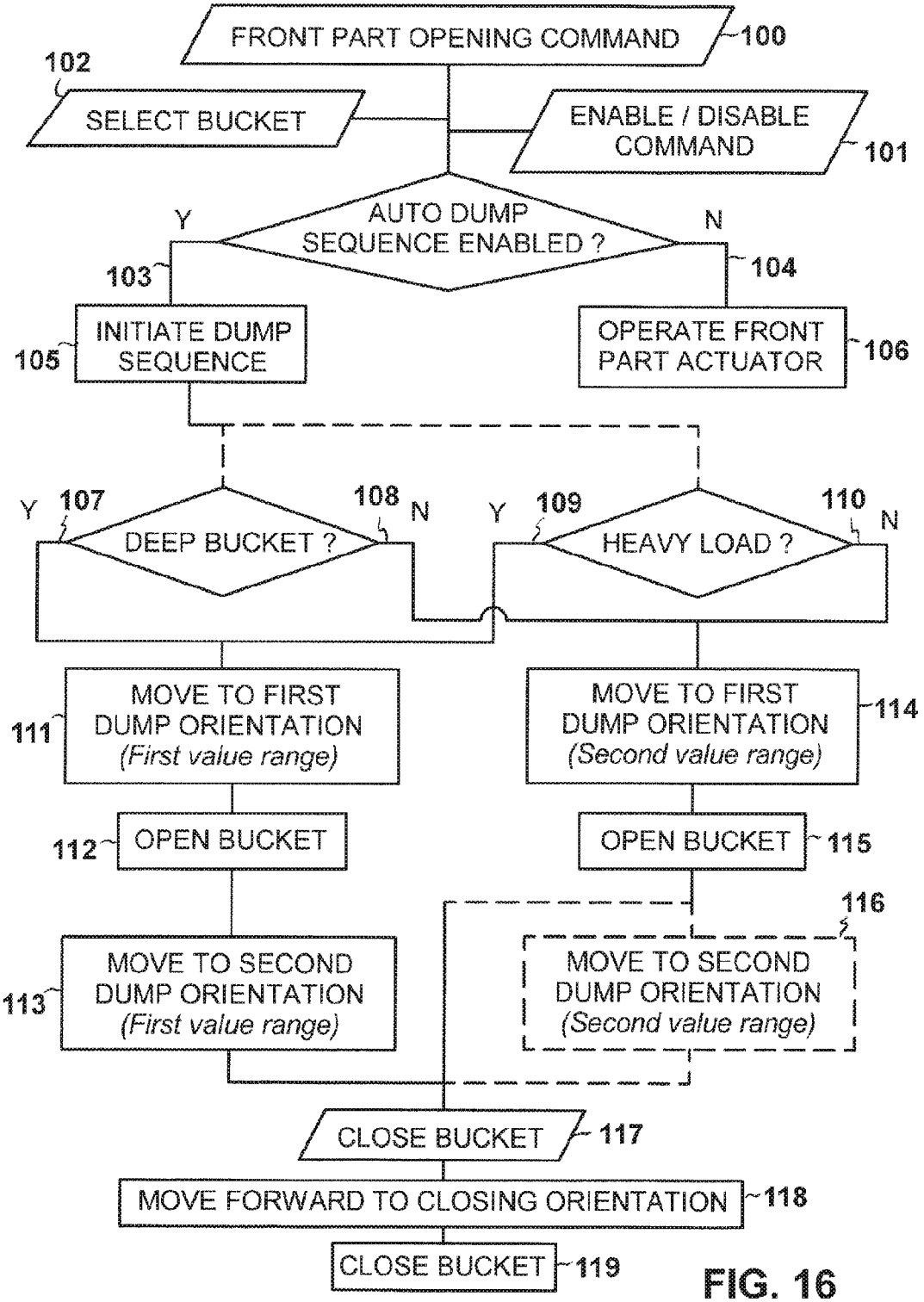
FIG. 16 is a flowchart showing various methods of operation.

Referring also to FIG. 16, in order to ensure that the bucket is correctly oriented as shown in FIG. 4 during the dumping operation, the control system 70 is arranged to control the actuator assembly 50 to implement a method of operation defining an automatic dump sequence, also referred to hereinafter simply as the dump sequence. The dump sequence is a predefined sequence of movements of the bucket, which may be stored in a memory 72 of the control system and executed by a processor unit 73 responsive to a trigger condition comprising at least a dump command 100, also referred to herein as a front part opening command 100, which is received via the user controls 60. The user may execute the dump command 100 in any convenient way, for example by depressing the switch or trigger 61 on the joystick, perhaps in combination with the safety button 63.

The dump sequence may be implemented responsive to receiving the dump command 100 in combination with another command or sensor input from load or position sensors 71, for example, indicating that the front part 20 is in the digging configuration or that the machine has moved (e.g. slewed) to an expected dump position.

The control system 70 may be arranged to selectively enable and disable the dump sequence responsive to an enable/disable command 101 received via the user controls 60, for example, at a previous time during the operator's shift and stored in the memory 72. The selection could be made between two alternative operating modes, for example, by selectively operating an automatic dump mode selector 65 or a manual dump mode selector 66 on a control panel or display 74, so as to persist for example for the duration of operation of the vehicle during the operator's shift.

When the automatic dump sequence is disabled 104, the control system 70 may control the actuator assembly 50 in response to the operator's front part opening command 100 to open the bucket 10, 10', which is to say, to move the front part 20 at step 106 from the digging configuration to the dumping configuration, either in a single predefined movement responsive to a single operator input, or as a continuous movement which is maintained until the operator releases the respective control (such as the trigger 61), as preferred.

When the automatic dump sequence is enabled 103, the control system 70 may initiate the automatic dump sequence 105 in response to the front part opening command 100.

Alternatively, the automatic dump sequence could be initiated 105 by issuing the dump command 100 via a separate control, for example, by a button 64, so that if the operator prefers a manual mode of operation he may selectively control the opening of the front part 20 of the bucket 10, 10' by pressure on another control such as the trigger 61. Of course, the automatic dump sequence could also be arranged as a default option without a manual alternative, to obviate the possibility of incorrect manual operation.

Figure 9:
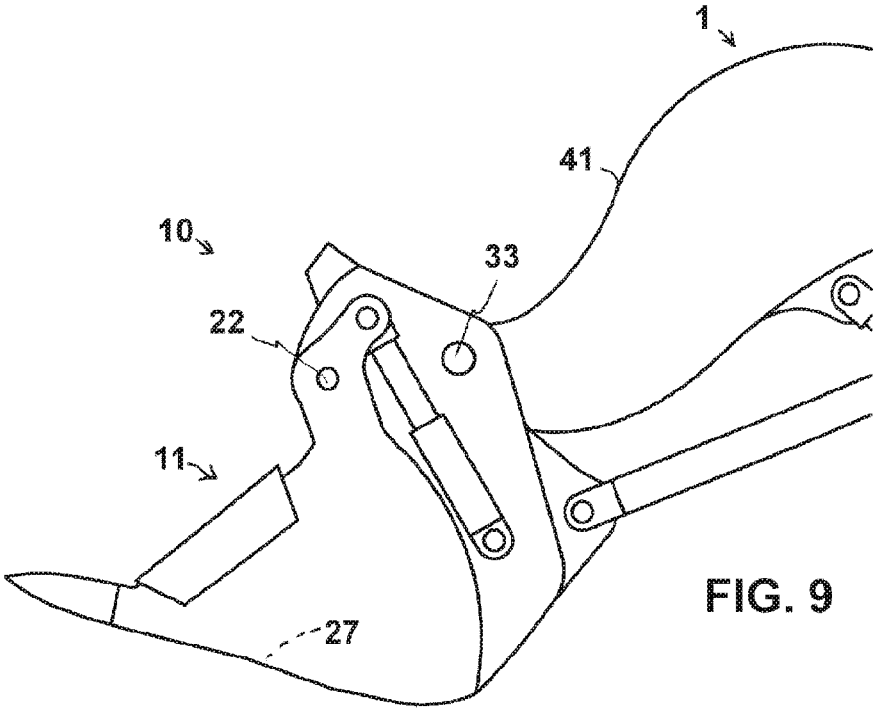
FIG. 9 shows the bucket in the closed (digging) configuration and the second dump orientation.
Figure 10:
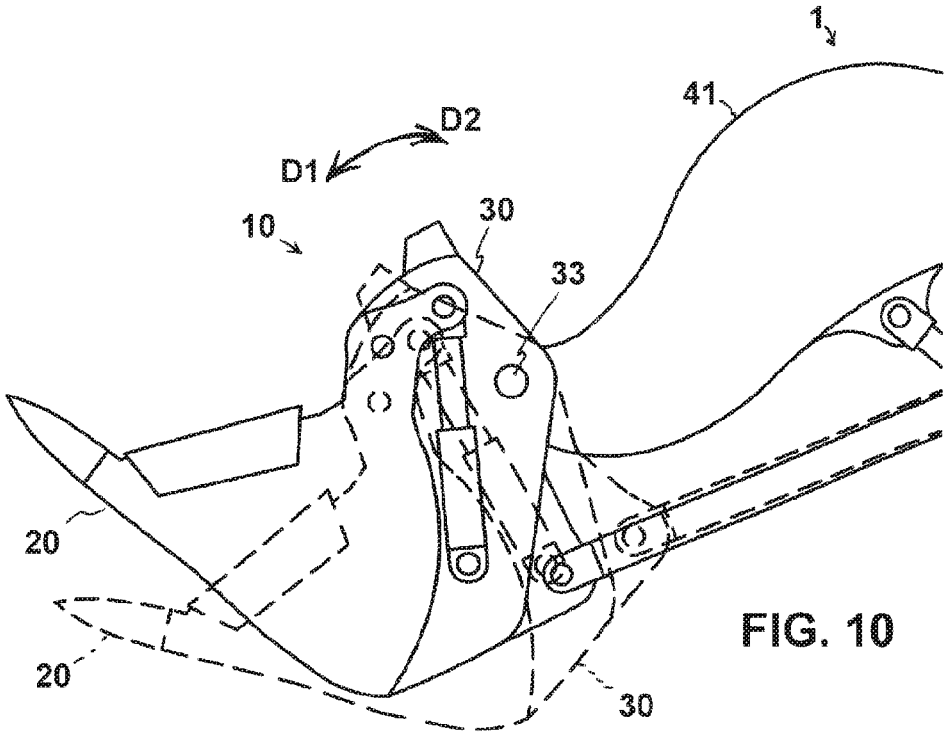
FIG. 10 shows a first, pre-positioning step in which the bucket is moved to a first dump orientation.

The dump sequence comprises a pre-positioning step 111 or 114 in which, with the front part 20 in the digging configuration, the rear part 30 is moved in rotation to a first dump orientation, for example, from the position shown in FIG. 9 and in broken lines in FIG. 10 to the first dump orientation as shown in solid lines in FIG. 10. The first dump orientation is a first predefined angular position or range of angular position of the rear part 30 in the angular range of movement, which may be stored in the memory 72 and determined by the processor unit 73 based on input from the position sensors 71 which are arranged to sense the relative positions of all the moving parts of the machine.

Figure 11:
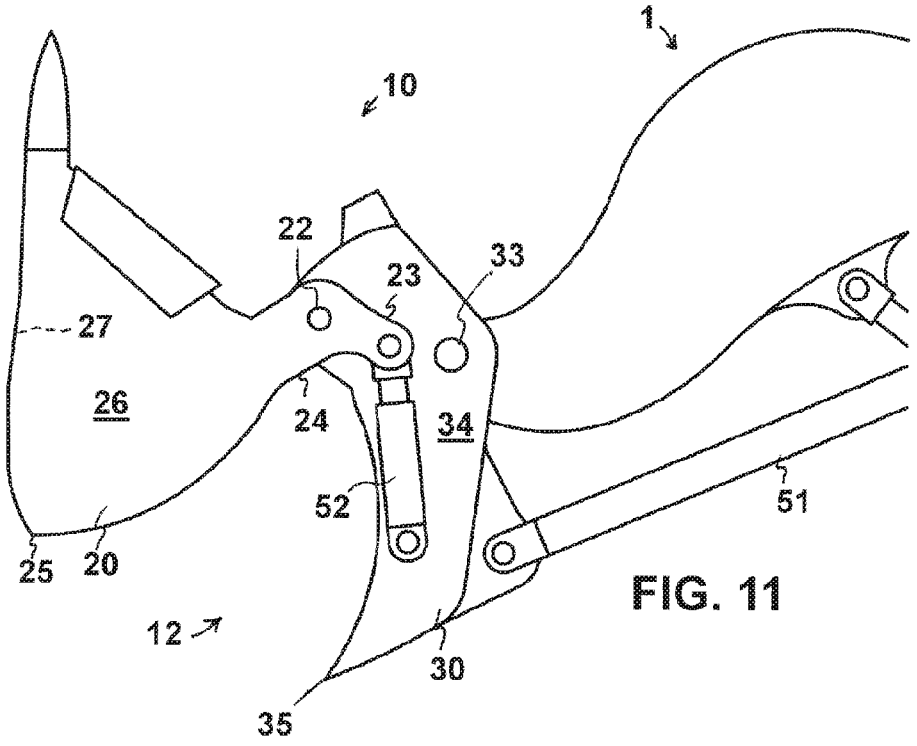
FIG. 11 shows an opening step in which the front part is moved, with the rear part in the first dump orientation, to the open (dumping) configuration.

The dump sequence further comprises an opening step 112 or 115 which is performed after the pre-positioning step to open the bucket 10, 10' by moving the front part 20 from the digging configuration to the dumping configuration, for example, to the position as shown in FIG. 11.

The first dump orientation may be selected so that when the front part 20 is moved to the dumping configuration the loose material 2 is discharged in the desired trajectory from the dumping aperture 12.

Optionally, the control system 70 may be arranged to change the first predefined angular position or range of positions responsive to a first dump orientation adjustment command received via the user controls 60. For example, the user controls 60 may be configured to allow the user to adjust the angle of the rear part 30 to suit the particular material 2 being dumped, or to optimise the angle for a particular type of bucket 10 or 10'.

Alternatively or additionally, the load sensors 71 of the control system may be arranged to sense the weight of a load of loose material 2 in the bucket (for example, by sensing hydraulic pressure in the respective actuator or actuators) and to change the first predefined angular position or range of positions of the dump orientation responsive to the sensed load. For example, if 110 the sensed load is under a threshold weight, the first dump orientation at step 114 may be selected as a second value or a value within a second value range for that step 114, whereas if 109 the sensed load is over a threshold weight, the first dump orientation at step 111 may be selected as a first value or a value within a first value range for that step 111, wherein, relative to the second value range, the angle of the rear part 30 is oriented more in the rearward direction D2 to reduce the load on the front part 20 so that the front part can open more easily at step 112.

Where first and second buckets 10', 10 are provided with different capacities, the control system 70 may be arranged to change the first predefined angular position or range of positions between a first predefined value or value range optimised for the first bucket 10' and a second predefined value or value range optimised for the second bucket 10, for example, by selectively operating 102 on the control panel 74 a bucket selector function 68 to select the first bucket 10', or bucket selector function 67 to select the second bucket 10.

The first dump sequence may be adapted in accordance with the selection to select the first dump orientation 107 for the deeper bucket or 108 for the smaller bucket.

For example, since the first bucket 10' has a deeper configuration with a relatively less steeply inclined base wall 32, the first dump orientation for the first bucket 10' might be steeper (e.g. corresponding to the position of the second bucket 10 as shown in broken lines in FIG. 10) than that for the second bucket 10 (e.g. as shown in solid lines in FIG. 10).

Alternatively, if for example the first bucket 10' is found to be difficult to open with a full load, the first dump orientation might be adjusted rearwardly relative to that for the second bucket so as to relieve the load from the opening actuators 52.

Where the first dump orientation is selected (e.g. as a single pre-programmed value or as a set or range of alternative values selectable by the operator) to relieve the load from the front part 20 so that the actuators 52 can open the front part 20 more easily, the dump sequence may comprise a further movement or re-positioning step 113 or 116, which may be carried out during, after, or both during and after the opening step 112 or 115.

It will be understood of course that where this step or any other optional step is included in the dump sequence, it may be carried out automatically by the control system 70 after the preceding steps of the dump sequence, depending on the decision points or parameters previously set by the operator or input from sensors 71 but otherwise without requiring further initiation by the operator. Alternatively the control system might prompt the operator to input a command confirming that the control system should move to the next pre-programmed step of the dump sequence, for example as stored in the memory 72. In either case, the dump sequence will be automatic in the sense that it is carried out in accordance with a predefined sequence, e.g. a sequence stored in memory, which may include a predefined position or range of position of each respective part of the machine involved in the sequence. Thus, the moving parts are moved by the control system 70 in accordance with the pre-defined sequence of movements rather than purely in response to operator input via the user controls.

Figure 12:
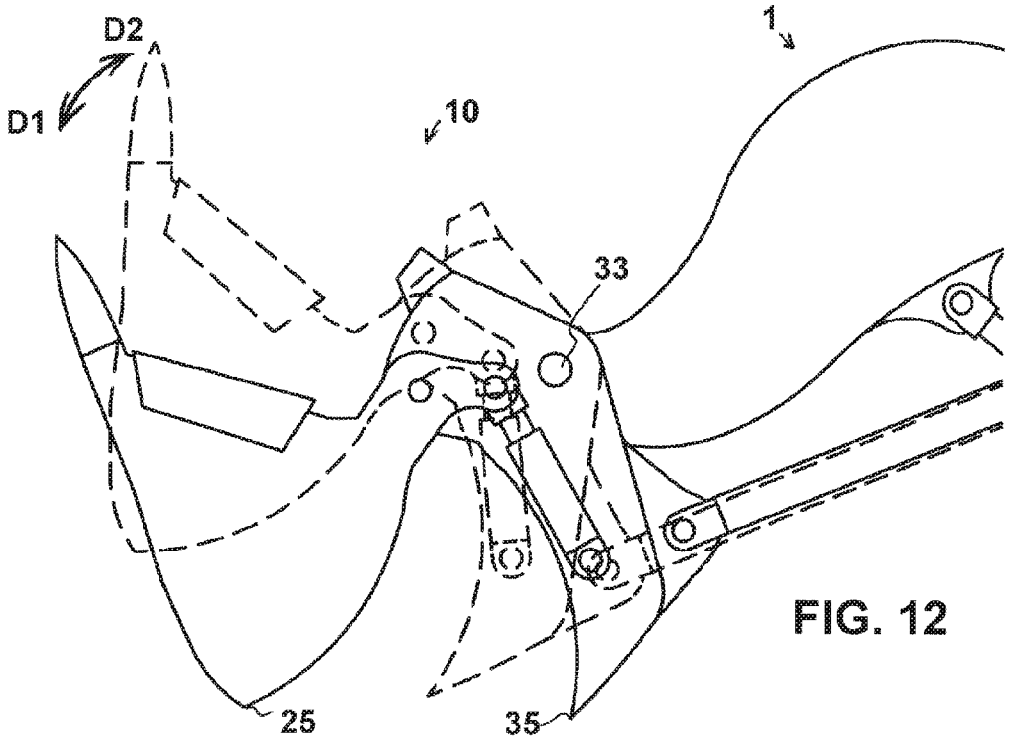
FIG. 12 shows a re-positioning step in which the rear part is moved forwardly, with the front part in the open (dumping) configuration, from the first dump orientation (shown in broken lines) to the second dump orientation (shown in solid lines)

In the re-positioning step 113 or 116, with the front part 20 in the open, dumping configuration, the rear part 30 is moved in rotation in the forward direction D1 away from the first dump orientation (as shown in FIG. 11 and in broken lines in FIG. 12), which is selected to allow the front part 20 to open more easily, to a second dump orientation as shown for example in solid lines in FIG. 12. The second dump orientation is a second predefined angular position or range of angular position of the rear part 30 in the angular range of movement, and is selected to allow the loose material 2 to fall out of the dumping aperture 12 in the desired trajectory as shown in FIG. 4.

Where as described above the control system is configured to select at step 102 between two alternative interchangeable bucket types 10, 10' with different capacities, the control system may be arranged to change one or both of the first and the second predefined angular positions or ranges of positions, defining respectively the first dump orientation at step 111 or 114 and the second dump orientation at step 113 or 116, to correspond to the bucket type selected at step 102. Thus, at the re-positioning step 113 or 116, the control system may select between a second predefined value or value range for that step 116 optimised for the smaller, second bucket 10, and a first predefined value or value range for that step 113 optimised for the first, deeper bucket 10'.

Alternatively or additionally, the control system may be arranged to sense via load sensors 71 the weight of the load of loose material 2 in the bucket, and to enable the re-positioning step 113 or disable the re-positioning step 116 responsive to the sensed load. In this case, the control system may be arranged to change the first predefined angular position or range of positions defining the first dump orientation between a first predefined value or value range for that step 111, and a second predefined value or value range for that step 114. The first predefined value or value range (step 111) may be selected when the re-positioning step 113 is enabled, and the second predefined value or value range (step 114) when the re-positioning step 116 is disabled.

For example, if 109 there is a heavy load, the first value or value range may be selected to provide a relatively rearwardly inclined first dump orientation at step 111 to help the front part 20 to open, whereas if 110 the load is below the threshold weight, the second value or value range of the first dump orientation at step 114 may be selected to be the same as the first value or value range of the second dump orientation at step 113, so that the second part 20 can open in the optimal orientation of the rear part 30 to discharge the load as shown in FIG. 4 without requiring a re-positioning step 116.

Alternatively or additionally, the control system may be arranged to change or select the first predefined angular position or range of positions for the first dump orientation between a first predefined value or value range (step 111) optimised for a first bucket 10', and a second predefined value or value range (step 114) optimised for a second bucket 10, and to enable the re-positioning step 113 when the first predefined value or value range is selected, and to disable the re-positioning step 116 when the second predefined value or value range is selected.

Thus for example, if the first, deep bucket 10' is being used, the first dump orientation may be oriented slightly more rearwardly to relieve the load from the front part 20 while it opens at step 111, and then re-oriented at step 113 (during and/or after the opening movement) to the optimal discharge position. If the second, smaller bucket 10 is in use, the first dump orientation at step 114 may be slightly more forwardly oriented at the optimal discharge angle so that no re-positioning step 116 is required.

Optionally, the dump sequence may comprise a further movement or closing sequence to close the bucket after the loose material has been discharged through the dumping aperture 12. The further movement may be triggered automatically responsive to opening the bucket at step 112 or 115 or, where a re-positioning step is provided, responsive to moving the rear part 30 to the second dump orientation at step 113 or 116, perhaps after a time delay or after load sensors 71 indicate that the material has been discharged. Alternatively, and responsive also to the completion of the preceding step in the automatic sequence, the further closing movement may be triggered responsive to a "close bucket" command received from the user controls at step 117. As with the other steps, the closing sequence may be selected or de-selected by a persistent operator setting or a momentary operator selection via the user controls. It could be performed responsive to operator input which, if the closing sequence is de-selected, initiates the manual closing of the bucket, similarly to the arrangement discussed above where the dump command may be interpreted as a manual front part opening command, depending on whether the automatic dump sequence has been preselected or deselected.

Figure 7:
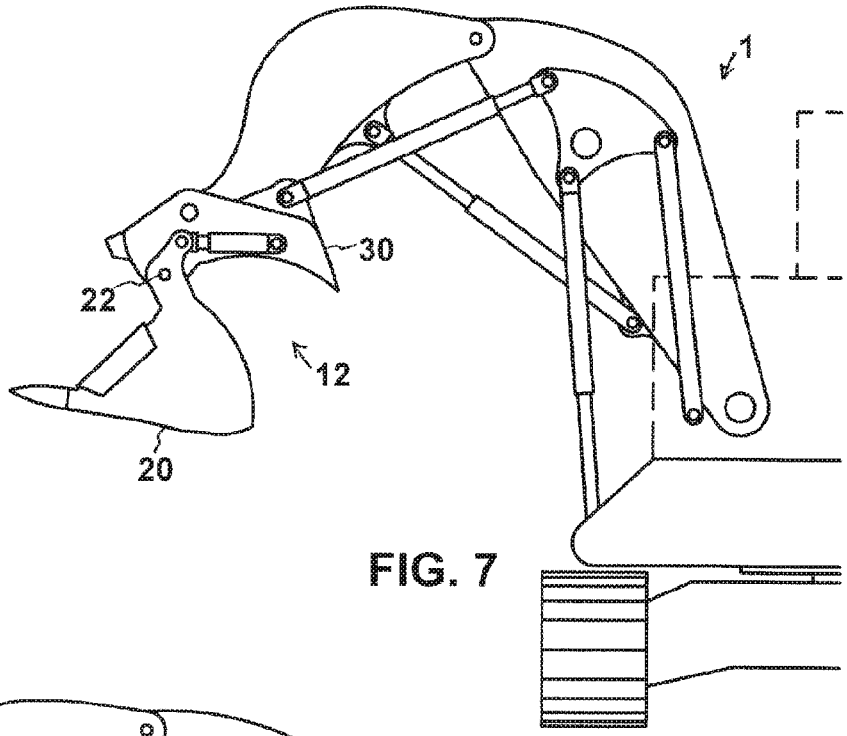
FIGS. 7 and 8 show the digging machine with its bucket rotated forwardly to a more steeply downwardly facing, closing orientation, respectively in the dumping configuration (FIG. 7) and the digging configuration (FIG. 8)
Figure 8:
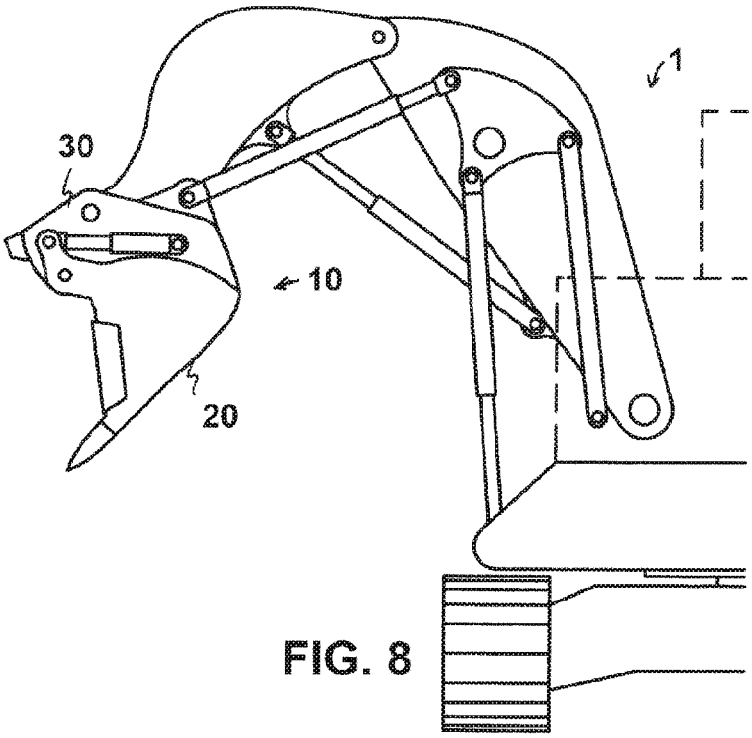

In the closing sequence, after the preceding opening step 112 or 115 or re-positioning step 113 or 116, and optionally, also responsive to the "close bucket" command at step 117, in a first closing step 118 the rear part 30 is moved in rotation in the forward direction D1 away from the first dump orientation (or, if the re-positioning step was performed, away from the second dump orientation) to a closing orientation as shown in FIG. 7. The closing orientation is a further predefined angular position or range of angular position of the rear part 30 in the angular range of movement, and is selected so that the front part 20 hangs down beneath the rear part 30. In this orientation, either during, after, or both during and after the first closing step, in a second closing step 119, the front part 20 is moved from the dumping configuration to the digging configuration to close the bucket as shown in FIG. 8. The actuators 52 work against the weight of the front part 20 so that the bucket closes progressively and safely.

The machine 1 can then return (e.g. slew) back to the digging position and resume digging, which is to say, introduce further material via the digging aperture into the bucket.

INDUSTRIAL APPLICABILITY

The novel machine and method may be configured to provide a repeatable and more accurate dumping operation while allowing the operator full manual control of the digging operation. The repeatable dumping position may reduce abrasion damage to the interior surfaces of the bucket and reduce fuel consumption by reducing the opening load on the actuators 52.

In summary, a digging machine such as a face shovel is controlled in an automated dumping sequence in which the bucket is pivoted to a first angular orientation before opening and, optionally, re-orienting to a second, slightly more forwardly inclined angular orientation. The first orientation may relieve the front part of the bucket from the load while the second orientation is selected to discharge the load at an optimal trajectory. The bucket may move to a third angular orientation before closing the front part against gravity.

The novel machine may be configured in particular as a face shovel, although other configurations are possible. In alternative embodiments the arm assembly and other components of the machine may be configured and articulated other than as shown. For example, it is conceivable for the front part of the bucket to be mounted on another component of the machine rather than directly on the rear part of the bucket, or for the arm assembly to be formed in one part or in three or more parts.

Many further possible adaptations within the scope of the claims will be evident to those skilled in the art.

In the claims, reference characters and numerals are provided in parentheses purely for ease of reference and are not to be construed as limiting features.

The invention claimed is:

1. A digging machine comprising:

a bucket, an arm assembly supporting the bucket, an actuator assembly for moving the bucket and arm assembly to crowd loose material into the bucket and to dump the loose material from the bucket, and a control system including user controls, the control system being arranged to control the operation of the actuator assembly responsive to user commands received via the user controls;

the bucket comprising a front part, a rear part, and a digging aperture through which, in a digging configuration of the front part, loose material may be crowded into the bucket;

the rear part being pivotably mounted on the arm assembly;

the actuator assembly being configured to move the rear part in rotation, when considered in a vertical plane, in opposite, forward and rearward directions through a range of angular positions in an angular range of movement, wherein in the digging configuration of the front part, the forward direction is defined as an angular movement away from an upwardly facing orientation of the bucket and towards a downwardly facing orientation of the bucket, and the rearward direction is defined as an angular movement away from the downwardly facing orientation of the bucket and towards the upwardly facing orientation of the bucket;

the front part comprising a leading edge of the digging aperture;

the front part being moveable in rotation by the actuator assembly relative to the rear part between the digging configuration and a dumping configuration, wherein in the dumping configuration respective edges of the front part and rear part are separated to define between said edges a dumping aperture through which loose material may fall downwardly out of the bucket in the upwardly facing orientation of the bucket, and in the digging configuration the front and rear parts are closed together to retain the loose material in the bucket in the upwardly facing orientation of the bucket;

wherein the control system is arranged, responsive to at least a dump command received via the user controls, to control the actuator assembly to move the bucket in a dump sequence, the dump sequence comprising a predefined sequence of movements:

(i) in a pre-positioning step, in the digging configuration of the front part, to move the rear part in rotation to a first dump orientation, the first dump orientation being a first predefined angular position or range of angular position of the rear part in the angular range of movement; and then (ii) after the pre-positioning step, in an opening step, to move the front part from the digging configuration to the dumping configuration.

2. A The digging machine according to claim 1, wherein the dump sequence comprises a further movement;

(iii) during, after, or both during and after the opening step, in a re-positioning step, to move the rear part in rotation in the forward direction away from the first dump orientation to a second dump orientation, the second dump orientation being a second predefined angular position or range of angular position of the rear part in the angular range of movement.

3. The digging machine according to claim 2, wherein the dump sequence comprises a further movement:

(iv) after the re-positioning step, in a first closing step, to move the rear part in rotation in the forward direction away from the second dump orientation to a closing orientation, the closing orientation being a further predefined angular position or range of angular position of the rear part in the angular range of movement; and then (v) during, after, or both during and after the first closing step, in a second closing step, to move the front part from the dumping configuration to the digging configuration.

4. The digging machine according to claim 2, wherein a first and second said bucket are provided, the first and second buckets being selectively mountable on the arm assembly and having different capacities; and the control system is arranged to change each of the first and the second predefined angular positions or ranges of positions, respectively between a first predefined value or value range optimised for the first bucket and a second predefined value or value range optimised for the second bucket.

5. The digging machine according to claim 2, wherein a first and second said bucket are provided, the first and second buckets being selectively mountable on the arm assembly and having different capacities; and the control system is arranged to change the first predefined angular position or range of positions between a first predefined value or value range optimised for the first bucket and a second predefined value or value range optimised for the second bucket, and to enable the repositioning step when the first predefined value or value range is selected, and to disable the re-positioning step when the second predefined value or value range is selected.

6. The digging machine according to claim 2, wherein the control system is arranged:

to sense a load of said loose material in the bucket, and to enable or disable the re-positioning step responsive to the sensed load, and to change the first predefined angular position or range of positions between a first predefined value or value range and a second predefined value or value range, and to select the first predefined value or value range when the re-positioning step is enabled, and to select the second predefined value or value range when the re-positioning step is disabled.

7. The digging machine according to claim 1, wherein the dump sequence comprises a further movement:

(iii) after the opening step, in a first closing step to move the rear part in rotation in the forward direction away from the first dump orientation to a closing orientation, the closing orientation being a further predefined angular position or range of angular position of the rear part in the angular range of movement; and then (iv) during, after, or both during and after the first closing step, in a second closing step, to move the front part from the dumping configuration to the digging configuration.

8. The digging machine according to claim 1, wherein a first and second said bucket are provided, the first and second buckets being selectively mountable on the arm assembly and having different capacities; and the control system is arranged to change the first predefined angular position or range of positions between a first predefined value or value range optimised for the first bucket and a second predefined value or value range optimised for the second bucket.

9. The digging machine according to claim 1, wherein the user controls include a front part opening control, the front part opening control being operable by a user to generate a front part opening command; and the control system is arranged:

to selectively enable and disable the dump sequence responsive to an enable/disable command received via the user controls, and when the dump sequence is disabled, to control the actuator assembly to move the front part from the digging configuration to the dumping configuration responsive to the front part opening command; and when the dump sequence is enabled, to initiate the dump sequence responsive to the front part opening command.

10. A method of operating a digging machine, the machine comprising:

a bucket, an arm assembly supporting the bucket, an actuator assembly for moving the bucket and arm assembly to crowd loose material into the bucket and to dump the loose material from the bucket, and a control system including user controls, the control system being arranged to control the operation of the actuator assembly responsive to user commands received via the user controls;

the bucket comprising a front part, a rear part, and a digging aperture through which, in a digging configuration of the front part, loose material may be crowded into the bucket;

the rear part being pivotably mounted on the arm assembly;

the actuator assembly being configured to move the rear part in rotation, when considered in a vertical plane, in opposite, forward and rearward directions through a range of angular positions in an angular range of movement, wherein in the digging configuration of the front part, the forward direction is defined as an angular movement away from an upwardly facing orientation of the bucket and towards a downwardly facing orientation of the bucket, and the rearward direction is defined as an angular movement away from the downwardly facing orientation of the bucket and towards the upwardly facing orientation of the bucket;

the front part comprising a leading edge of the digging aperture;

the front part being moveable in rotation by the actuator assembly relative to the rear part between the digging configuration and a dumping configuration, wherein in the dumping configuration respective edges of the front part and rear part are separated to define between said edges a dumping aperture through which loose material may fall downwardly out of the bucket in the upwardly facing orientation of the bucket, and in the digging configuration the front and rear parts are closed together to retain the loose material in the bucket in the upwardly facing orientation of the bucket;

the method comprising:

controlling the actuator assembly, by the control system, responsive to at least a dump command received via the user controls, to move the bucket in a dump sequence, the dump sequence comprising a predefined sequence of movements including:

(i) in a pre-positioning step, in the digging configuration of the front part, moving the rear part in rotation to a first dump orientation, the first dump orientation being a first predefined angular position or range of angular position of the rear part in the angular range of movement; and then (ii) after the pre-positioning step, in an opening step, moving the front part from the digging configuration to the dumping configuration.

11. A The method according to claim 10, wherein the dump sequence comprises a further movement:

(iii) during, after, or both during and after the opening step, in a re-positioning step, to move the rear part in rotation in the forward direction away from the first dump orientation to a second dump orientation, the second dump orientation being a second predefined angular position or range of angular position of the rear part in the angular range of movement.

12. The method according to claim 11, wherein the dump sequence comprises a further movement:

(iv) after the re-positioning step, in a first closing step, to move the rear part in rotation in the forward direction away from the second dump orientation to a closing orientation, the closing orientation being a further predefined angular position or range of angular position of the rear part in the angular range of movement; and then (v) during, after, or both during and after the first closing step, in a second closing step, to move the front part from the dumping configuration to the digging configuration.

13. The method according to claim 11, wherein a first and second said bucket are provided, the first and second buckets being selectively mountable on the arm assembly and having different capacities; and including the further step of changing, by the control system, each of the first and the second predefined angular positions or ranges of positions, respectively between a first predefined value or value range optimised for the first bucket and a second predefined value or value range optimised for the second bucket.

14. The method according to claim 10, wherein the dump sequence comprises a further movement:

(iii) after the opening step, in a first closing step, to move the rear part in rotation in the forward direction away from the first dump orientation to a closing orientation, the closing orientation being a further predefined angular position or range of angular position of the rear part in the angular range of movement; and then (iv) during, after, or both during and after the first closing step, in a second closing step, to move the front part from the dumping configuration to the digging configuration.

15. The method according to claim 10, wherein a first and second said bucket are provided, the first and second buckets being selectively mountable on the arm assembly and having different capacities; and including the further step of changing, by the control system, the first predefined angular position or range of positions between a first predefined value or value range optimised for the first bucket and a second predefined value or value range optimised for the second bucket.

* * * * *